US005292225A

United States Patent [19]

Dyer

[11] Patent Number: 5,292,225

[45] Date of Patent: Mar. 8, 1994

[54] OVERSPEED PROTECTION APPARATUS FOR A TURBOMACHINE

[75] Inventor: Glenn E. Dyer, Ocala, Fla.

[73] Assignee: Westinghouse Electric Corp., Pittsburgh, Pa.

[21] Appl. No.: 946,692

[22] Filed: Sep. 18, 1992

[51] Int. Cl.[5] ..... F01D 17/00; F01D 21/00

[52] U.S. Cl. ..... 415/29; 60/657

[58] Field of Search ..... 415/25, 26, 29, 30, 415/36; 60/657, 660

[56] References Cited

U.S. PATENT DOCUMENTS

| | | | |
|---|---|---|---|
| 1,947,128 | 2/1934 | Franck | 415/29 |
| 2,091,669 | 8/1937 | Bryant | 415/29 |
| 2,383,219 | 8/1945 | Schwendner | 415/29 |
| 3,393,692 | 7/1968 | Geary | 415/29 |
| 3,466,977 | 9/1969 | Veller et al. | 415/29 |

FOREIGN PATENT DOCUMENTS

| | | | |
|---|---|---|---|
| 65201 | 5/1979 | Japan | 415/29 |
| 43906 | 3/1984 | Japan | 415/26 |

*Primary Examiner*—Edward K. Look
*Assistant Examiner*—James A. Larson
*Attorney, Agent, or Firm*—G. R. Jarosik

[57] ABSTRACT

An overspeed trip system for a steam turbine. A pressure switch is installed at the discharge of an oil pump that is driven by the rotor shaft and that rotates at the same speed as the rotor. The discharge pressure of the oil pump is proportional to the rotational speed of its impeller. When the pressure switch senses that the oil pump discharge pressure exceeds a predetermined value, thereby indicating that the rotor has reached an overspeed condition, it activates a solenoid operated valve that causes oil to be dumped from the line supplying control oil pressure to a throttle valve actuator. The throttle valve is spring loaded to close so that when the oil is dumped, the throttle valve closes, thereby effecting a turbine trip.

3 Claims, 3 Drawing Sheets

OVERSPEED PROTECTION APPARATUS FOR A TURBOMACHINE

BACKGROUND OF THE INVENTION

The present invention relates to an apparatus for protecting the rotor of a turbomachine, such as a steam or gas turbine or the like, from overspeeding. More specifically, the present invention relates to a backup overspeed trip apparatus that relies on the pressure produced by a pump driven by the turbomachine shaft to determine when a predetermined speed has been exceeded.

Steam turbine power plants typically employ electro-hydraulic control systems that perform a variety of functions, including tripping—that is, shutting down on an emergency basis—the turbine when certain conditions arise. Such conditions include those indicating imminent damage to the turbine—for example, low bearing oil pressure, rotor overspeed, and high condenser pressure. Typically, steam turbines are tripped by closing the throttle valve that controls the introduction of high pressure steam to the turbine. Such throttle valves typically employ a hydraulic actuator. However, since it is important to close such valves as quickly as possible upon tripping, the throttle valve is spring loaded to close. Thus, pressure from a hydraulic fluid must be exerted on the valve operator to keep the valve open. This hydraulic pressure is maintained in a closed loop system by a pump driven by the turbine rotor.

Typically, sensors for bearing oil pressure, condenser pressure, etc. are incorporated into a trip control block. These sensors are coupled to a trip valve that is in flow communication with the hydraulic fluid supplied to the throttle valve actuator. A trip is accomplished by actuating the trip valve so as to dump the hydraulic fluid to a vented drain tank, thereby dropping the pressure to the throttle valve actuator so that the spring automatically closes the throttle valve. In addition to the trip control block, separate trip devices are also typically provided by mechanical and electrical overspeed trip devices.

Traditionally, a lockout device was incorporated into the hydraulic system that allowed the trip devices—that is, the trip block and the mechanical overspeed trip—to be temporarily isolated from the throttle valve actuator, thereby allowing the trip devices to be tested without tripping the turbine. However, this left the turbine unprotected should a trip condition arise during testing. Even during the relatively short time period necessary to test the trip control block, is unwise to leave the turbine unprotected from a rotor overspeed. A rotor overspeed, if unchecked, can cause the rotor to fly apart, resulting in substantial damage to the turbine and surrounding equipment. In a nuclear power plant, such a rotor failure can have catastrophic consequences.

Consequently, during the time the lockout device is actuated, protection against a rotor overspeed condition was provided by an electrical tachometer that transmitted a signal to a solenoid operated trip valve. This trip valve dumped hydraulic fluid supplied to the throttle valve actuator to a drain, thereby closing the throttle valve if the speed exceeded a predetermined value. Unfortunately, such backup valves have been known to malfunction during testing of the trip control block, thereby permitting a damaging rotor overspeed condition to occur.

It is therefore desirable to provide an overspeed protection device that can not be disabled by the traditional trip lockout device and that operated independently of the mechanical and electrical tripping devices heretofore used.

SUMMARY OF THE INVENTION

Accordingly, it is the general object of the current invention to provide an overspeed trip system for a turbomachine that can be operated independently of other mechanical or electrical overspeed trip devices.

Briefly, this object, as well as other objects of the current invention, is accomplished in a turbomachine comprising (i) a rotor for producing shaft horsepower, (ii) means for pumping a fluid to a pressure, (iii) means for transmitting the shaft horsepower from the rotor to the pumping means for driving the pumping means, (iv) means for sensing the pressure to which the fluid is pumped by the pumping means, (v) overspeed trip means for preventing the rotor speed from exceeding a predetermined value, and (vi) means for actuating the overspeed trip means in response to the pressure sensed by the pressure sensing means.

In one embodiment of the invention, the pumping means comprises a rotating pumping element and the pressure to which the fluid is pumped is proportional to the rotational speed of the pumping element. In addition, the shaft horsepower transmitting means has means for rotating the pumping element at a rotational speed that is proportional to the rotational speed of the rotor, thereby allowing the speed of rotation of the rotor to be determined by sensing the pressure to which the fluid is pumped.

DESCRIPTION OF THE PREFERRED EMBODIMENT

Figure 1:
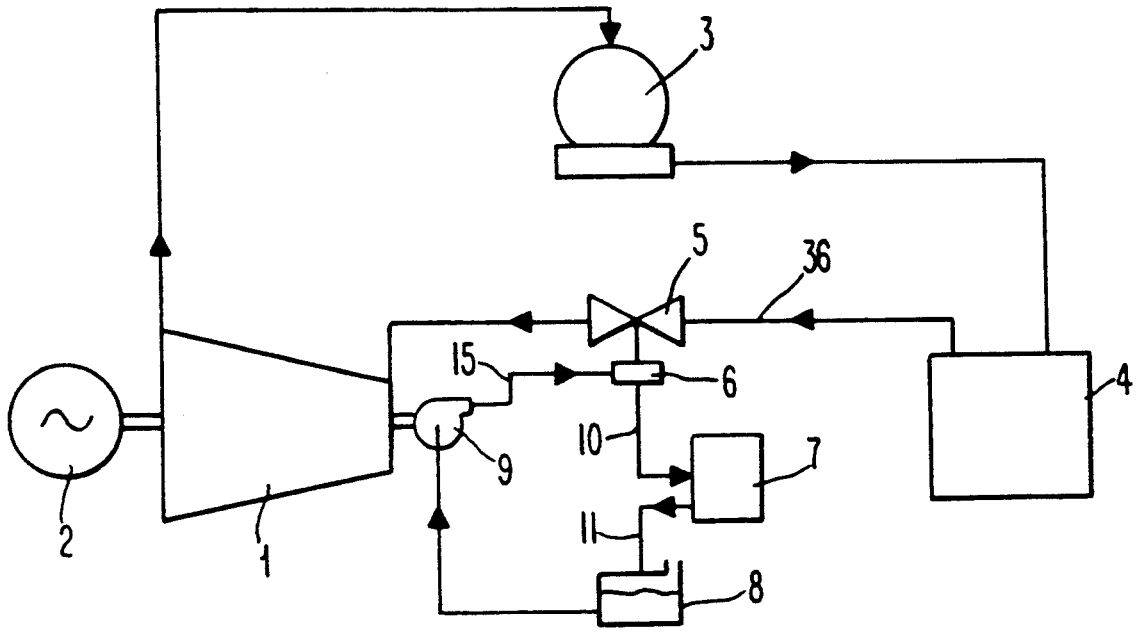
FIG. 1 is a schematic diagram of a steam turbine power plant.

Referring to the drawings, wherein like numerals represent like elements, there is illustrated in FIG. 1, a steam turbine power plant. The major components of the power plant include a steam turbine 1, an electrical generator 2, a condenser 3 and a steam generator 4. The steam generator 4 converts feed water from the condenser 3 to steam. The steam is directed to the steam turbine 1, which extracts energy therefrom to drive the electrical generator 2 and then exhausts the steam to the condenser 3.

The flow of steam to the turbine is regulated by a throttle valve 5. As is conventional, the throttle valve 5 is operated by a hydraulic actuator 6 supplied with pressurized hydraulic fluid from an electro-hydraulic control system. The major components of the electro-hydraulic control system are a pump 9, an emergency trip oil header 10, drain 11, tank 8 and trip control block 7, all arranged in a closed loop system. The pump 9 draws hydraulic fluid from the vented tank 8 and directs it to the throttle valve actuator 6. As previously discussed, the flow of fluid to the throttle valve actuator 6 in the closed loop hydraulic system is controlled by the trip control block 7.

A turbine trip is initiated by the trip control block 7, as follows. When actuated, a trip valve in the trip control block 7 causes oil in the emergency trip header 10 to be dumped to the drain 11. This causes the pressure in the emergency trip header 10 to be greatly reduced, thereby reducing the pressure of the oil acting on the throttle valve actuator 6. As a result, the spring in the throttle valve 5 causes the valve to immediately close, thereby stopping the flow of steam 36 from the steam generator 4 to the turbine 1.

Figure 2:
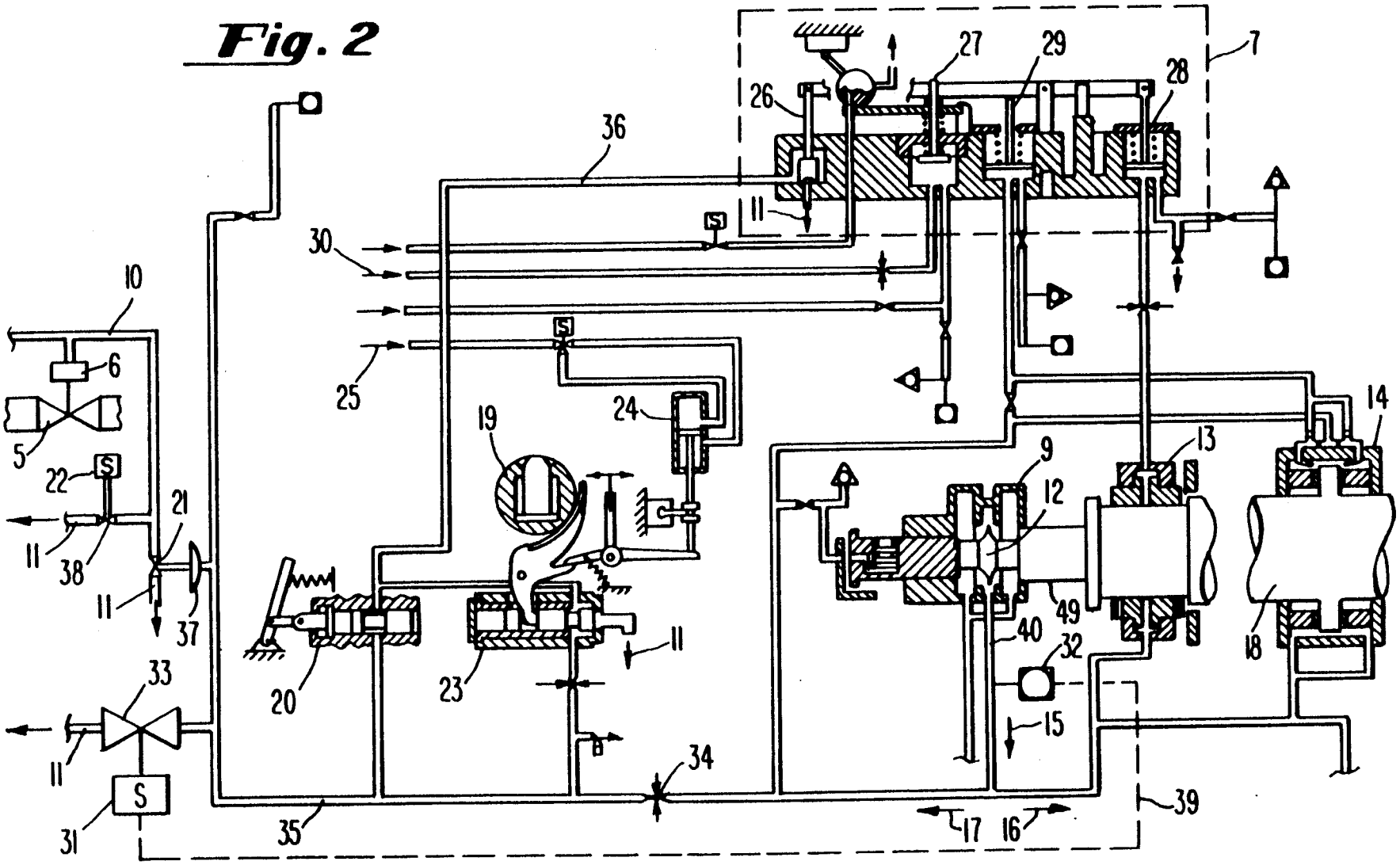
FIG. 2 is a schematic diagram of the electro-hydraulic control system according to the current invention.

The details of a portion of the electro-hydraulic control system are shown in FIG. 2. As shown, the oil pump 9 is of the centrifugal type and has a rotating impeller 12. The impeller 12 is directly coupled to the turbine rotor shaft 18 by a coupling 49 so that the impeller is driven by horsepower from the rotor and in synchronization with the rotor. As a result, the rotational speed of the impeller 12 is equal to the rotational speed of the rotor 18. As is conventional, the pressure at which the oil 15 is discharged from the oil pump 9 is proportional to the rotational speed of the impeller 12, as shown in the head curve 47 for the pump illustrated in FIG. 4.

The oil 15 from the pump 9 is divided into two streams 16 and 17. Stream 16 supplies oil for lubrication to a journal bearing 13 that supports the rotor 18, a thrust bearing 14, and other components in need of lubrication. Stream 17 supplies oil to a high pressure oil header 35 in the electro-hydraulic control system via an orifice 34.

As shown in FIG. 2, the trip control block 7 contains a variety of sensors 27, 28 and 29. Sensor 27 is actuated in response to a low condenser vacuum signal 30 from the condenser. Sensor 28 is actuated by low oil pressure in the journal bearing 13. Sensor 29 is actuated by high loading on the thrust bearing 14. Each of the trip sensors actuate a trip valve 26 that dumps oil from line 36 to the drain 11. During normal operation, a lockout device 20 in line 36 is open, so that line 36 is in flow communication with the high pressure oil header 35. Consequently, when the trip valve 26 opens and dumps oil to the drain 11, the pressure in line 36 and, consequently, in the header 35, drops rapidly.

The high pressure oil header 35 supplies oil to the actuator 37 of an interface valve 21. The interface valve 21 is spring loaded in the open direction. During normal operation, the pressure of the oil from the emergency trip header 35 maintains the interface valve 21 closed. However, when the trip valve 26 opens, the drop in pressure in the high pressure oil header 35 causes the interface valve to open under the action of its spring. The opening of the interface valve 21 caused oil from the emergency trip header 10, which supplies the throttle valve actuator 6, to be dumped to the drain 11, thereby closing the throttle valve 5, as previously discussed.

In addition to the trip sensors 27, 28 and 29 in the trip control block 7, the electro-hydraulic control system also features a mechanical overspeed trip device 19, which may be of the conventional centrifugal type in which a spring loaded plunger is mounted radially in the turbine shaft so that it moves outward under the urging of centrifugal force. The overspeed trip device 19 is coupled to an overspeed trip valve 23 that is closed at start-up by a remote latch 24 supplied with high pressure air 25 via a solenoid valve.

The spring force on the plunger of the overspeed trip device 19 is set so that the plunger travels outward sufficiently far to actuate the trigger of the overspeed trip valve 23 at a predetermined speed. The overspeed trip valve 23 is in flow communication with oil line 36 so that when its trigger is actuated causing it to open, the valve dumps oil from line 36 to the drain 11. As in the case when the trip control block trip valve 26 opens, the dumping of oil from line 36 causes a rapid drop in the pressure in the high pressure oil header 35, resulting in the opening of the interface valve 21 and the closing of the throttle valve 5.

Since steam turbines are intended to operate continuously for long periods of time, it is sometimes necessary to test the operation of the sensors and trip valve in the trip control block 7 without tripping the turbine. Consequently, a lockout device 20 is incorporated into line 36. When the lockout 20 is closed, line 36 is isolated from the high pressure oil header 35, so that the operation of neither the trip valve 26 nor the overspeed trip valve 23 has an effect on the pressure in the high pressure oil header 35. Thus, these components become incapable of shutting the throttle valve 5.

As previously discussed, although this arrangement allows the trip control block 7 to be tested without tripping the turbine, it leaves the turbine unprotected from undesirable operating conditions that would otherwise justify tripping the turbine. In this situation, a rotor overspeed presents the most hazard to equipment and personnel since its results can be considerably catastrophic. Consequently, a backup overspeed trip valve 38 is incorporated into the emergency trip header 10. The backup overspeed trip valve 38 is actuated by a solenoid 22 that is activated by an electrical overspeed trip (not shown).

Unfortunately, the backup overspeed trip valve 38 has been shown to be less than completely reliable. Consequently, according to the current invention, an additional trip valve 33 is connected to the high pressure oil header 35 and, when opened, places the header in flow communication with the drain 11. Thus, when the trip valve 33 is opened, the drop in pressure in the high pressure oil header 35 causes the interface valve 37 to open, thereby dumping oil from the emergency trip oil header 10 to the drain 11 and closing the throttle valve 5.

The trip valve 33 is operated by a solenoid 31. According to an important aspect of the current invention, the solenoid 31 is activated by a pressure switch 32. Pressure switch 32 is installed in the discharge line 40 from the oil pump 9 so that it senses oil pump discharge pressure. As shown in the oil pump 9 head curve 47 in FIG. 3, the discharge pressure, P, from the oil pump 9 has a fixed relationship to the rotational speed, RPM, of the pump impeller 12. Since the impeller 12 speed is equal to the rotor speed, there is a definite relationship between oil pump discharge pressure P and rotor rotational speed. Note that in the preferred embodiment, the oil pump 9 is directly mechanically coupled to the rotor shaft 18 so that their speeds are equal. However, the invention is equally applicable to arrangements in which the oil pump is mechanically coupled to the rotor by intermediate gearing so that the speed of the impeller 12 is some fraction or multiple of the rotor speed.

Figure 3:
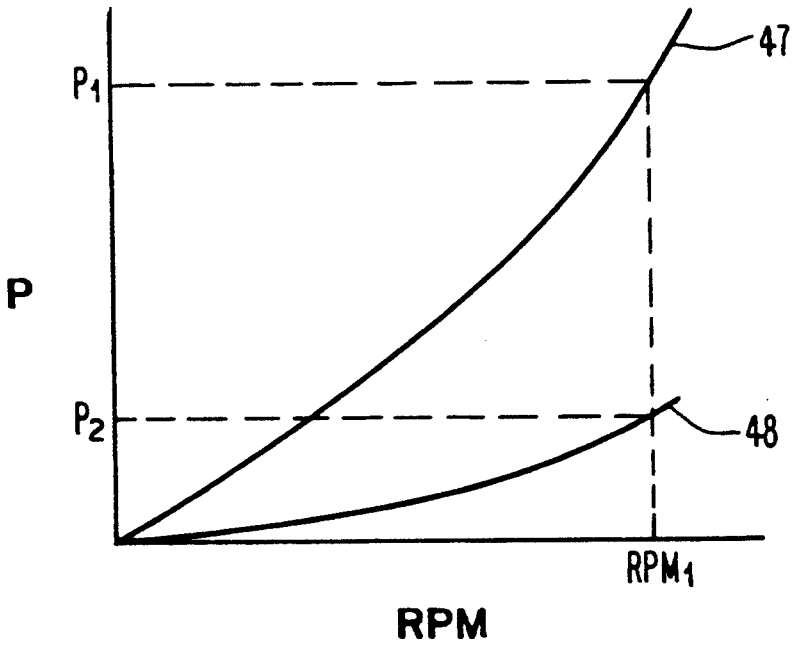
FIG. 3 shows head curves for an oil pump and a governor impeller.

According to the current invention, pressure switch 32 is adjusted to activate solenoid 31 whenever the oil pump 9 discharge pressure exceeds a predetermined value $P_1$ that corresponds to a predetermined impeller/-rotor speed $RPM_1$, as shown in FIG. 3. In the preferred embodiment, RPM is equal to approximately 111% of normal design speed, whereas the electrical overspeed trip device activates solenoid 22 of the backup trip valve at 103% of normal design speed and the mechanical overspeed trip mechanism 19 is adjusted to trip at 110% of normal design speed. Thus, the trip valve 33 and pressure switch 32 not only provide protection from a dangerous rotor overspeed during testing of the trip control block 7, they provide an additional and independent method of sensing rotor overspeed during normal operation that can be relied upon, if all else fails, to trip the turbine should the rotor overspeed.

Figure 4:
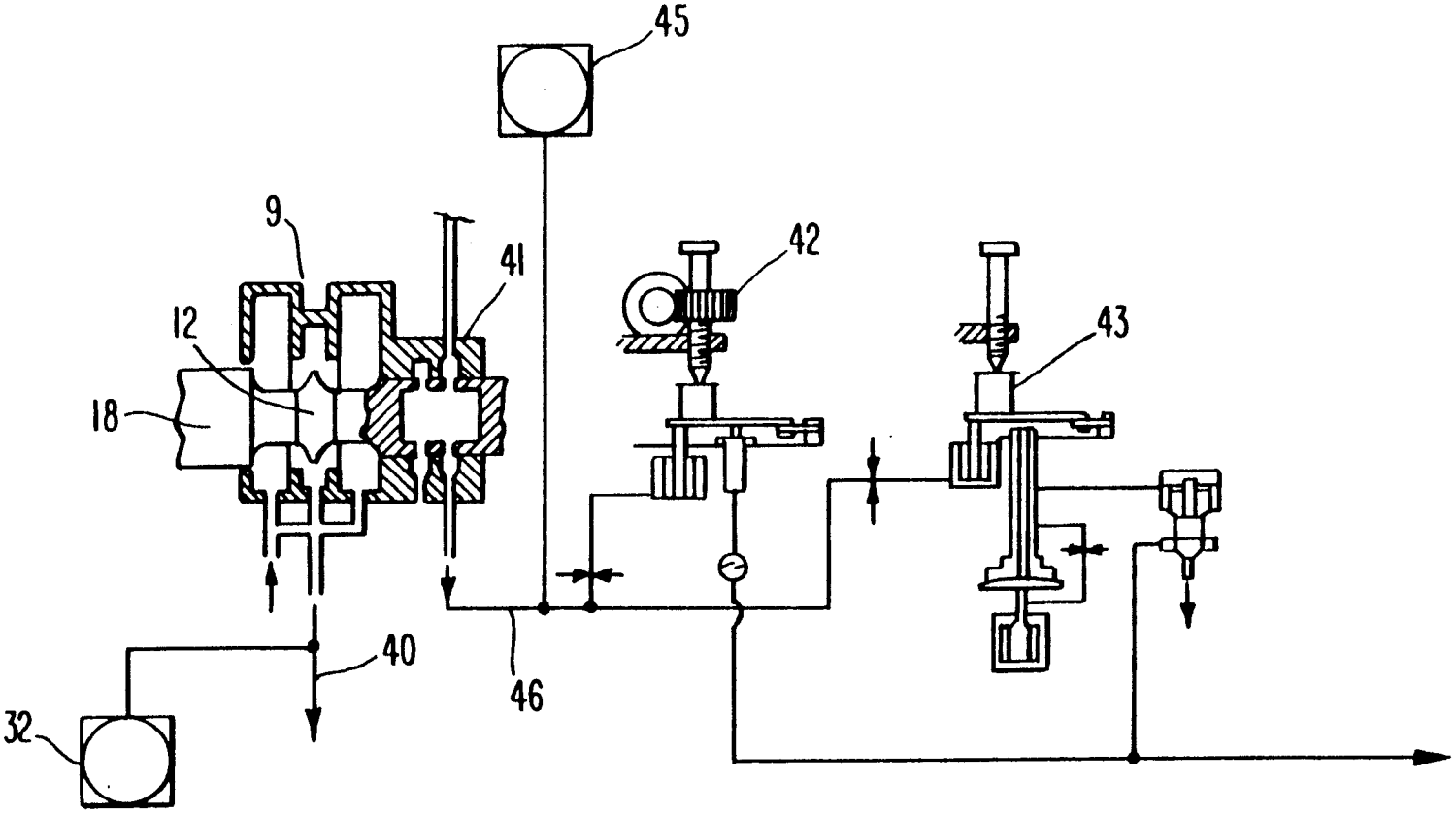
FIG. 4 is a schematic diagram of a portion of an alternated embodiment of the control system shown in FIG. 1.

FIG. 4 shows a further embodiment of the current invention advantageously incorporated into a mechanical-hydraulic control system in which the main oil pump 9 drives a governor impeller 41 that provides oil to a governor speed changer 42 and an auxiliary governor 43. The pressure of the oil discharging from the governor impeller 41, like the oil discharging from the oil pump 9, is proportional to its speed, as shown by the governor impeller 41 head curve 48 in FIG. 3. Moreover, the governor impeller 41 is directly mechanically coupled to the oil pump impeller 12. Thus, the speed of the governor impeller 41 is equal to the speed of the oil pump impeller 12 and the rotor 18.

According to the current invention, in this type of control system, a pressure switch 45 is installed in the discharge line 46 from the governor impeller 41, in addition to the pressure switch 32 in the discharge line 40 from the oil pump 9. Pressure switch 45 is adjusted to activate the trip valve solenoid 31, shown in FIG. 2, at a predetermined pressure $P_2$ that corresponds to approximately the same rotor speed $RPM_1$ as that associated with pressure $P_1$ in the oil pump 9. Thus, the pressure switch 45 provides further redundancy for the overspeed trip system.

Although the current invention has been described with reference to shutting the throttle valve in a steam turbine, the invention is equally applicable to shutting other valves in a steam turbine associated with a turbine trip, such as the intercepter and reheat stop valves Moreover, the invention may also be applied to other types of turbomachinery, such as a gas turbine wherein the oil pump pressure switch may be used to shut the fuel valve, thereby tripping the turbine. Accordingly, the present invention may be embodied in other specific forms without departing from the spirit or essential attributes thereof and, accordingly, reference should be made to the appended claims, rather than to the foregoing specification, as indicating the scope of the invention.

I claim:

1. In a steam turbine having (i) a rotor driven by a flow of steam, (ii) a first valve for admitting steam to said steam turbine, said first valve having an actuator actuated by pressure of a control fluid supplied thereto by a first header, whereby said first valve closes when the pressure of said control fluid in said first header drops below a first predetermined value, thereby tripping said steam turbine, (iii) a second valve in flow communication with said first header for dumping said control fluid in said first header to a drain when said second valve opens, said second valve having an actuator actuated by pressure of a control fluid supplied thereto by a second header, whereby said second valve opens when the pressure of said control fluid in said second header drops below a second predetermined valve, (iv) a pump for pressurizing said control fluid in said second header, said pump driven by rotation of said rotor, the pressure to which said control fluid is pressurized in said second header being proportional to the speed at which said rotor drives said pump, whereby said pressure in said second header is proportional to the rotational speed of said rotor, (v) first trip means in flow communication with said second header for tripping said steam turbine by dumping said control fluid supplied to said second valve actuator by said second header to a drain when said first trip means is actuated, thereby dropping said pressure of said control fluid in said second header below said second predetermined value and causing said second valve to open and said first valve to close, and (vi) means for actuating said first trip means when said rotor exceeds a first predetermined speed, a system for preventing overspeed of said rotor while testing said first trip means comprising:

a) a sensor for sensing said pressure to which said control fluid is raised by said pump;

b) a lockout device in flow communication with said second header and disposed between said first trip means and said second valve actuator for isolating said first trip means from said second header, whereby said first trip means can be tested without tripping said turbine;

c) second trip means in flow communication with said second header and disposed between said lockout device and said second valve actuator for tripping said steam turbine by dumping said control fluid supplied to said second valve actuator by said second header to a drain when said second trip means is actuated, whereby said lockout device does not isolate said second trip means from said second header; and d) means for actuating said second trip means when said fluid pressure sensed by said sensor exceeds a second predetermined value.

2. The system according to claim 1, wherein said pressure sensing means comprises a pressure switch.

3. The system according to claim 1, wherein said control fluid in said second header is oil and said pump is an oil pump.

* * * * *